US005713632A

United States Patent [19]

Su

[11] Patent Number: 5,713,632

[45] Date of Patent: Feb. 3, 1998

[54] SWIVEL CHAIR HAVING A BODY-FIT STRUCTURE

[76] Inventor: Ching-Chuan Su, No. 124, Han-Kou Rd., Chia-Yi City, Taiwan

[21] Appl. No.: 775,378

[22] Filed: Jan. 3, 1997

[51] Int. Cl.[6] ..... A47C 1/023

[52] U.S. Cl. ..... 297/312; 297/452.4; 297/284.3

[58] Field of Search ..... 297/312, 452.4, 297/201, 284.3, 314

[56] References Cited

U.S. PATENT DOCUMENTS

| | | | |
|---|---|---|---|
| 1,976,326 | 10/1934 | Carlton | 297/312 |
| 3,080,195 | 3/1963 | Berg | 297/312 |
| 4,707,028 | 11/1987 | Gamberini | 297/312 |
| 5,580,128 | 12/1996 | Johnson et al. | 297/452.4 |

*Primary Examiner*—Peter M. Cuomo
*Assistant Examiner*—Anthony D. Barfield
*Attorney, Agent, or Firm*—Bacon & Thomas

[57] ABSTRACT

A swivel chair having a body-fit structure is provided with a movable seat, a chair frame, an adjustable stud, a seat cushion split into two arched halves, springs, two sliding blocks, two fixing plates, and an extensible shade. The movable seat having octopus-like legs extending radiatedly provides the supporting footing at the bottom. The two arched halves of the seat cushion are supported by the fixing plates and the sliding blocks. The fixing plates are fixedly secured to the bottom of the two arched halves of the seat cushion, and engaged with the sliding blocks by inserting pins at one side and springs at the other side. By means of the adjustable stud passing through the two sliding blocks gliding on a groove track of the chair frame, the distance between the two arched halves of the seat cushion can be adjusted to best suit the hips of different people according to the physical shape of a human body so that a user can sit comfortably a long time on it without feeling tired or hurting the muscle of the person.

1 Claim, 6 Drawing Sheets

SWIVEL CHAIR HAVING A BODY-FIT STRUCTURE

BACKGROUND OF THE INVENTION

The present invention relates to a swivel chair having a body-fit, especially to a swivel chair including a seat cushion split into two arched halves, two fixing plates secured to the bottom of the arched halves, and two sliding blocks fixedly joined to the fixing plates at one side and resiliently engaged with the fixing plates via springs at the other side. And by means of an adjustable stud to regulate the movement of the two sliding blocks, the two arched halves of the seat cushion can be adjusted to suit the hips of different people so as to provide a swivel chair designed best in accordance with the physical shape of a human body.

Please refer to FIG. 1. Generally speaking, a conventional swivel chair as shown in FIG. 1 is integrally and fixedly structured. Yet, there are several drawbacks inherent in such a swivel chair.

First, the seat cushion is mostly formed into one piece with a sitting surface designed either straight flat or slightly arched. To sit on the seat cushion of the conventional swivel chair will cause pressure on human muscles, especially to the hips which are naturally formed round or oval in shape. It is not only quite tiresome to suit one's hips into an unsuitable sitting surface, but also quite unconformtable which in the long run may results in the disfiguration of the hips' shape such as flat hips.

Second, to sit a long time on the conventional swivel chair will hinder the normal development of human muscles like the hips, influencing the appearance of one's figure.

Third, the conventional swivel chair is not personally designed. Therefore, improper pose of sitting attitude may bad influence on a human body, especially on the spine because flat hips will reduce the protection to the spine.

SUMMARY OF THE PRESENT INVENTION

It is therefore the primary object of the present invention to provide a swivel chair having a body-fit structure, comprising a seat cushion split into two arched halves, and an adjustable stud to regulate the distance between the two arched halves to best suit the physical structure of a human body so that one can sit comfortably a long time on it without feeling tired or disfiguring one's physical shape like that of the hips.

BRIEF DESCRIPTION OF THE DRAWINGS

FIG. 2A is sectional enlarged view of the fixing plate of the present invention.

DETAILED DESCRIPTION OF THE PREFERRED EMBODIMENT

Figure 1:
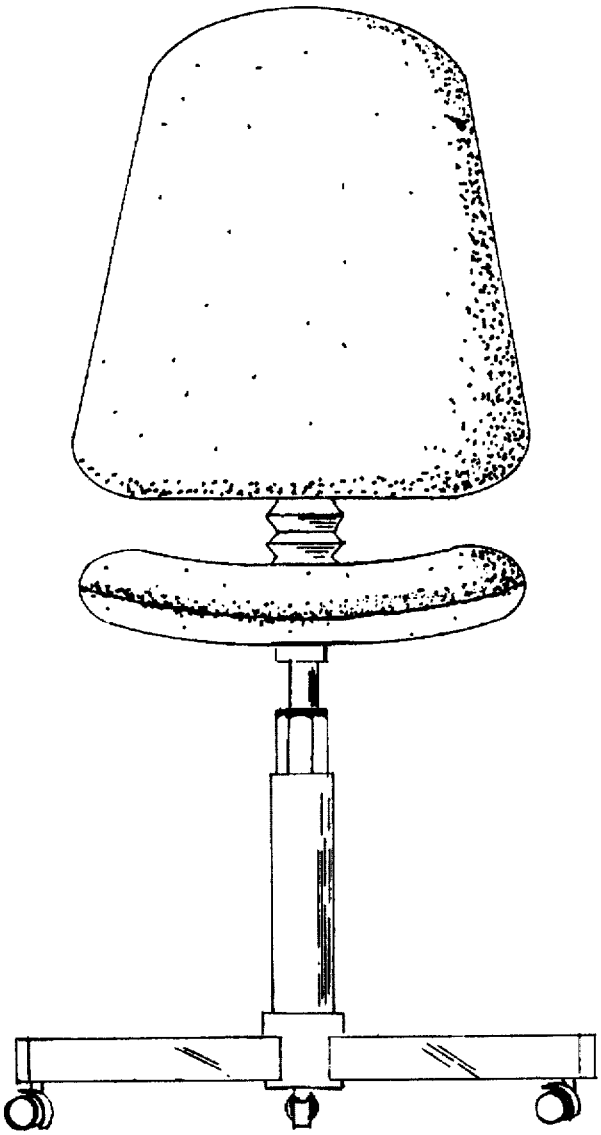
FIG. 1 PRIOR ART
FIG. 1 is a diagram showing the conventional swivel chair.
Figure 2:
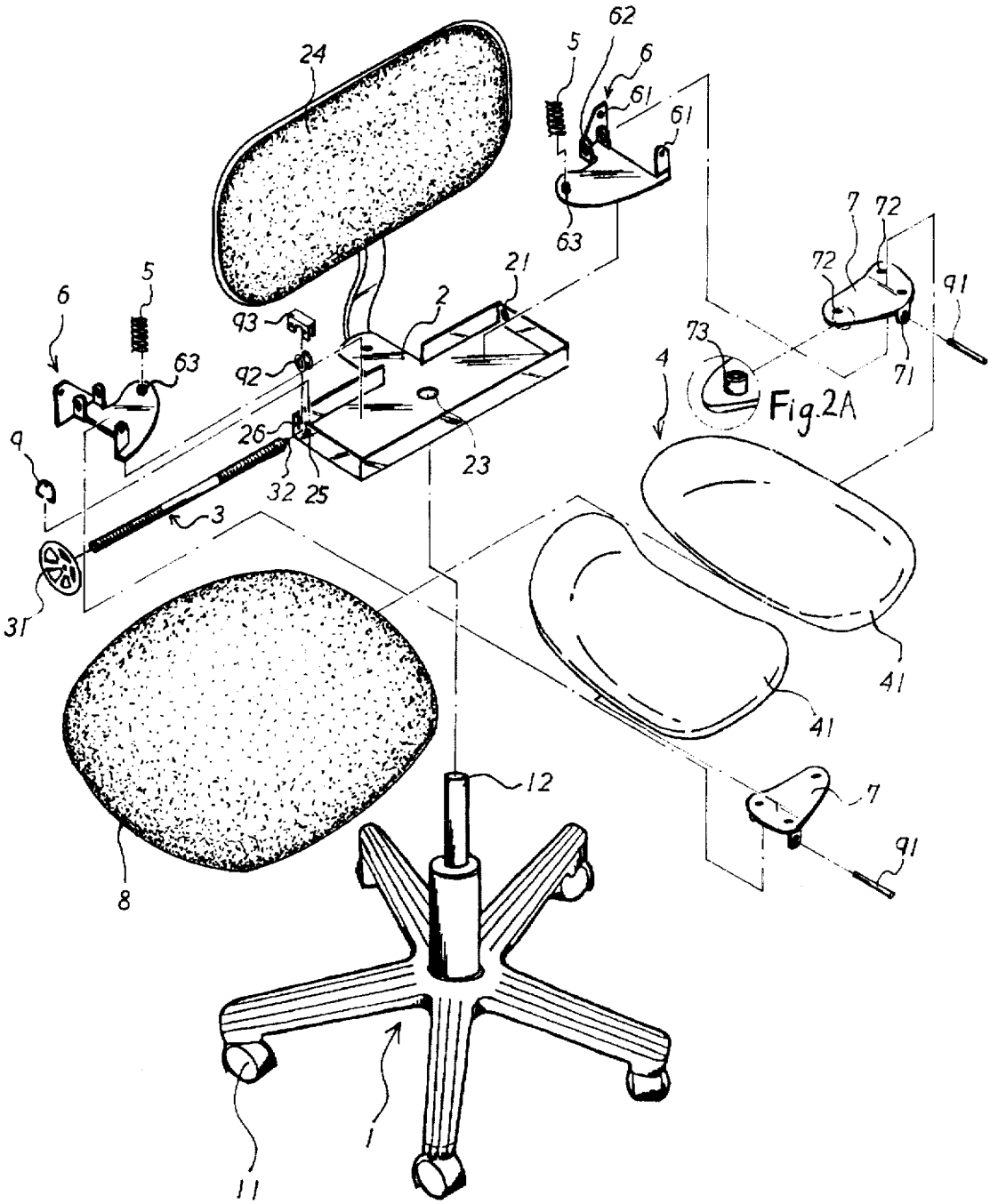
FIG. 2 is a perspective exploded view of the present invention.

The present invention relates to a swivel chair having a body-fit structure, especially to an office swivel chair designed best in accordance with the physical shape of a human body, comprising a movable seat 1, a chair frame 2, an adjusting stud 3, a seat cushion 4, springs 5, sliding blocks 6, fixing plates 7, and an extensible shade 8 as shown in FIG. 2.

Please refer to FIG. 2. The movable seat 1 provides a supporting footing to the swivel chair of the present invention, having a central conical axle 12 disposed at the top, and several octopus-like legs extending radially in all directions at the bottom, each leg provided with a movable wheel 11 thereon. The chair frame 2 is mainly formed by a rectangular hollow chamber having a locating hole 21 disposed at one lateral side and a U-shaped groove 25 having two screw holes 26 disposed at both lateral sides thereof. A groove track 22 is disposed at the interior front lateral side of the rectangular chamber of the chair frame 2, and an axle hole 23 is disposed at the central section of the rectangular chamber thereof. In addition, a backing 24 is disposed and supported by a backbone extending upwardly at the rear of the rectangular chamber of the chair frame 2.

The adjutable stud 3 having screw threads disposed at both right and left sections is adapted to match an adjusting wheel 31 at one end. And at the other end of the adjustable stud 3 is disposed a pivoting post 32 smaller in diameter than the adjustable shaft 3. The seat cushion 4 is split into two arch-shaped halves 41, each concentrating inwardly towards the center.

The sliding block 6 is mainly made up of a triangular plate, bent upwardly at a right angle at two opposite sides to provide two faces each having a through hole 61 disposed thereon. In addition, two opposite screw holes 62 are vertically provided between the two opposite through holes 61. And a first mounting seat 63 is provided at one side of the triangular plate of the sliding block 6.

The fixing plate 7 is a triangular plate, slanting slightly at both sides to match the arch of the seat cushion 4 whereon two pin holes 71 are vertically disposed at both tilting faces. Besides, a number of screw holes 72 are disposed on the surface of the fixing plate 7 and a second mounting seat 73 is disposed at one end of the fixing plate 7 as shown in FIG. 2A.

The extensible shade 8 is a resilient cover placed outside the seat cushion 4.

Figure 3:
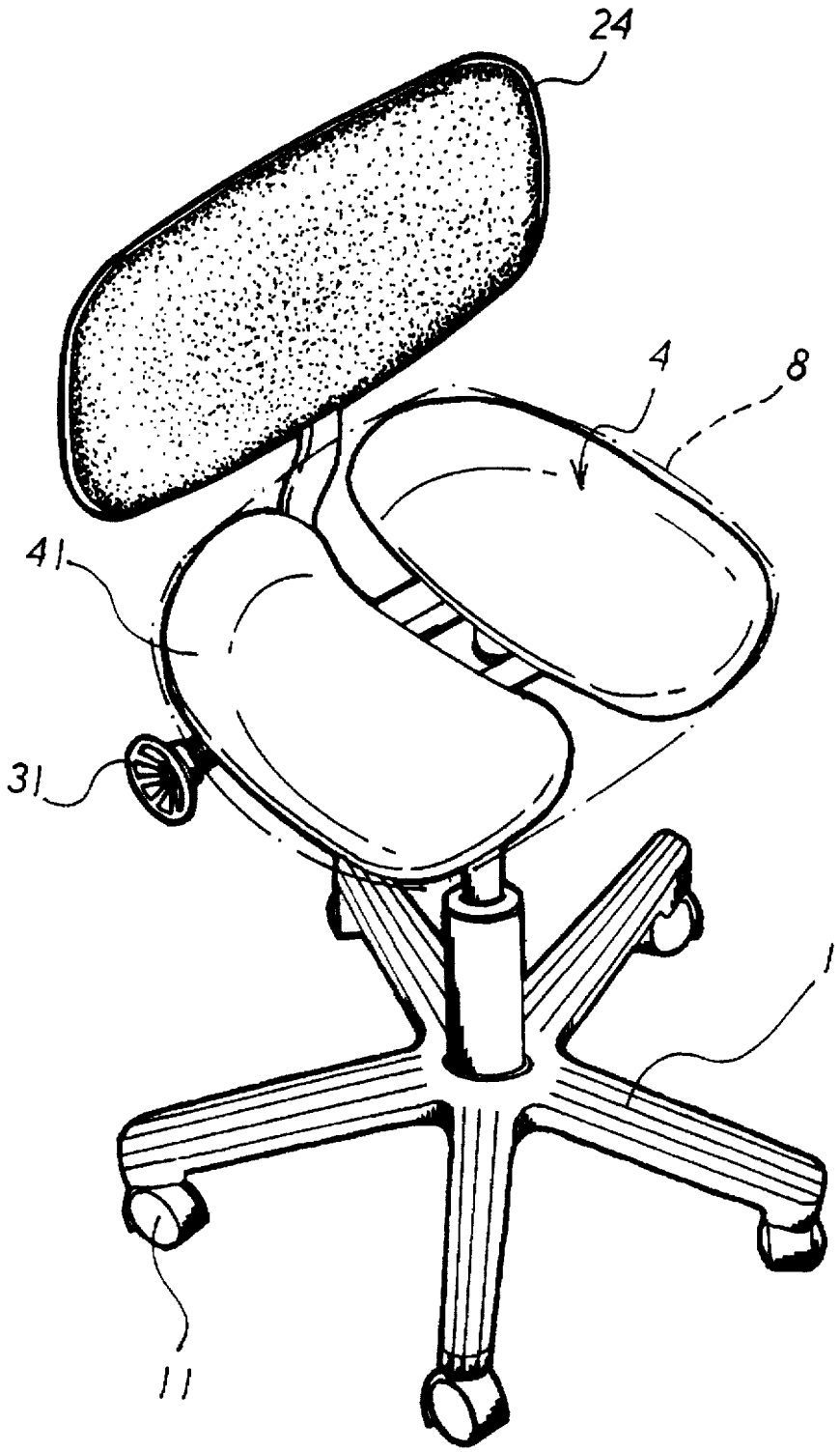
FIG. 3 is a perspective assembled view of the present invention.

Please refer to FIG. 3. To assemble the present invention, each of the two sliding blocks 6 is first engaged at both ends of the adjustable stud 3. The two opposite screw holes 62 of the sliding blocks 6 are passed and screwed up at both threaded ends of the adjustable stud 3. The pivoting post 32 disposed at one end of the adjustable stud 3 is then received within the locating hole 21 disposed at one lateral side of the chair frame 2. One side of the two sliding blocks 6 is located within the groove track 22 disposed at the interior front side of the chair frame 2. A rubber ring sleeve 92 is then adapted, led through one end of the adjustable stud 3 and mounted on the U-shaped groove 25 disposed at one lateral side of the chair frame 2. An inverted U-shaped block 93 defining an arch in the middle to match the curve of the rubber ring sleeve 92 is then mounted to the U-shaped groove 25 on top of the rubber ring sleeve 92. And the inverted U-shaped block 93 is further secured to the U-shaped groove 25 via screws passing through the screw holes 26 disposed at both sides of the U-shaped groove 25 so as to locate the adjustable stud 3 securely onto the chair frame 2. The adjusting wheel 31 is then engaged with the adjustable stud 3. In addition, an E-shaped washer 9 matching the gap of the inverted U-shaped block 93 is tapped inside the inverted U-shaped block 93 so as to faciliate the adjustable stud 3 rotating stably.

The movable seat 1 can then be engaged with the chair frame 2. The central conical axle 12 of the movable seat 1 is sleeve joined to the central axle hole 23 of the chair frame 2. And the two fixing plates 7 are engaged with the two arched halves 41 of the seat cushion 4 respectively via screws passing through the screw holes 72 disposed at the surface of the fixing plate 7 and securing the two fixing plates fixedly to the bottom of the two arched halves 41 thereof. Both ends of the springs 5 are engaged with first and second mounting seats 63, 73 disposed at one side of the sliding block 6 and the fixing plate 7 respectively. Inserting pins 91 are adapted to engage the pin holes 71 of the fixing plates 7 with the through holes 61 of the sliding blocks 6 so as to lock securedly the other side of the sliding blocks 6 and the fixing plates 7. Finally, the extensible shade 8 is applied to cover the exterior of the seat cushion 4 to complete the assembly of the present invention.

Figure 4:
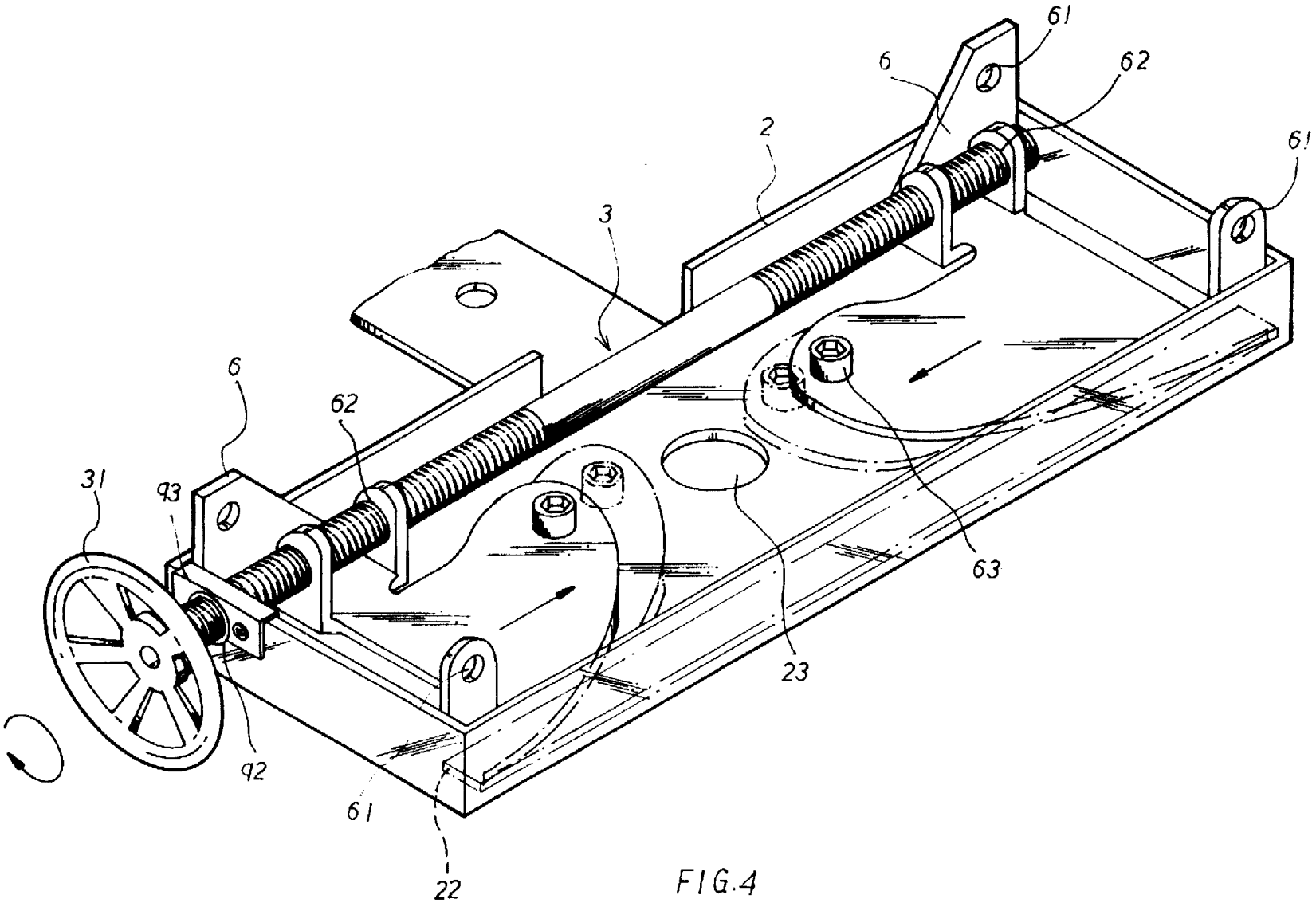
FIG. 4 is an operational view showing the mechanism of the present invention.
Figure 5:
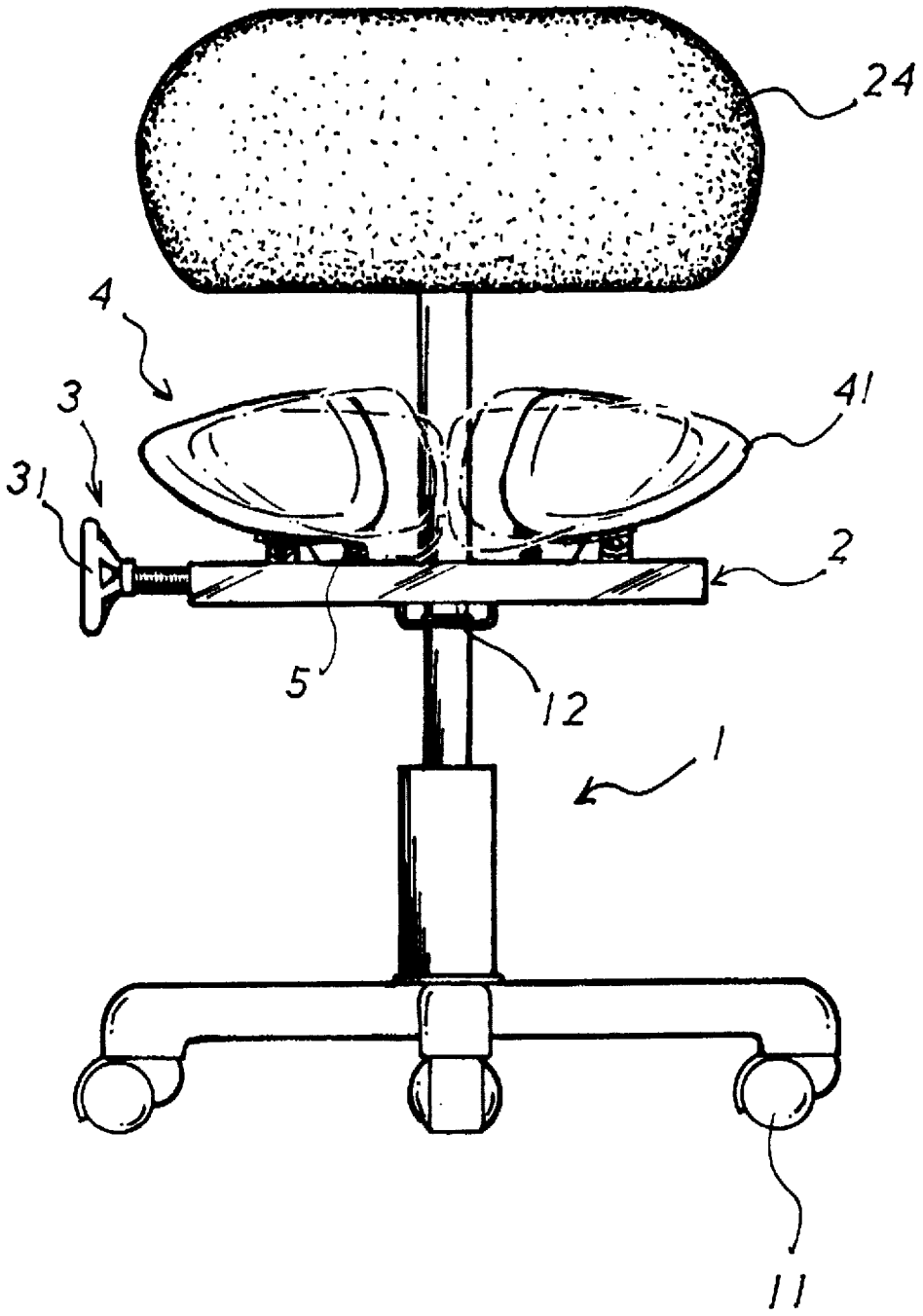
FIG. 5 is an operational view showing the embodiment of the present invention.
Figure 6:
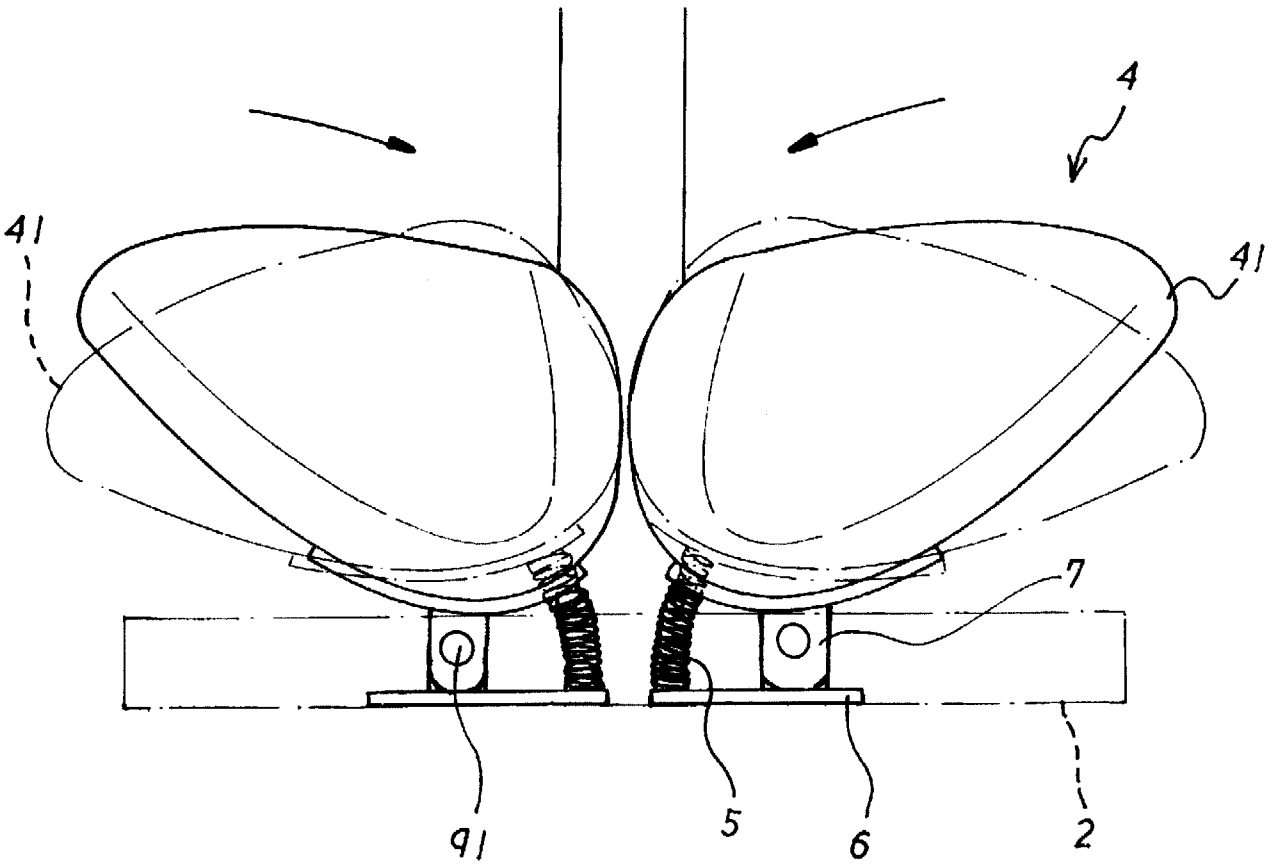
FIG. 6 is an operational view showing the two arched halves of the seat cushion resiliently supported by the spring of the present invention.

Please refer to FIG. 4. In application, the two arched halves 41 of the seat cushion 4 are kept naturally by a curve, supported by the sliding blocks 6 and the fixing plates 7 fixedly joined by inserting pins 91 at one side and resiliently supported by springs 5 at the other side. To adjust the seat cushion 4, the adjustable stud 3 can be rotated by means of the adjusting wheel 31 so as to regulate the distance between the two arched halves 41 to match the hips of different people. And resiliently supported by the springs 5 at one side, the two arched halves 41 when compressed downwardly by the weight of a human body will concentrate inwardly by an arch to receive naturally the hips of a user. Consequently, the user can sit comfortably a long time on the seat without causing any pressure on the hips. Besides, the arched halves 41 of the seat cushion 4 concentrating inwardly can also serve to regulate the sitting pose of a user best in accordance with the physical shape of a person.

What is claimed is:

1. A swivel chair having a body-fit structure, comprising a movable seat stand, a chair frame, an adjustable stud, a seat cushion, springs, sliding blocks, and fixing plates wherein:

the movable seat stand has a plurality of radially extending legs, each leg having a moving wheel disposed thereon to provide a supporting footing for the swivel chair, and a central conical axle disposed at a top;

the chair frame is mounted on the axle of the movable seat stand and is formed with a rectangular hollow chamber, the chamber having a locating hole disposed at one lateral side and an U-shaped groove disposed at an opposite lateral side, a middle section of said rectangular hollow chamber having a central axle hole and an interior front lateral side thereof having a groove track;

a seat back supported by a backbone extending from a rear of the chair frame;

the adjustable stud rotatably mounted on the chair frame, the adjustable stud having screw threads disposed on left and right sections thereof and is provided with a pivoting post smaller in diameter than said adjustable stud at one end and an adjusting wheel at an opposite end;

a plurality of sliding blocks, each sliding block located on the chair frame and threadingly engaged with one of the left and right sections of the adjustable stud, each sliding block comprising a triangular plate having two upwardly extending portions with through holes disposed thereon, and a first mounting seat disposed on one side;

one of the fixing plates pivotally connected to each sliding block, each fixing plate comprising a triangular plate provided with two pin holes, a pin passing through the two pin holes and the through holes of one of the sliding blocks, and a second mounting seat on each fixing plate;

the seat cushion comprising a pair of arched seat halves, one arched seat half attached to each fixing plate, each arched seat half being resiliently supported by a spring extending between first and second mounting seats; and, a resilient cover disposed over exteriors of the arched seat halves, whereby rotation of the adjustable stud, varies a distance between the two arched seat halves of the seat cushion to suit the hips of different people in accordance with the physical shape thereof.

* * * * *